United States Patent [19]

Martin

[11] 4,072,099

[45] Feb. 7, 1978

[54] APPARATUS FOR APPLYING AND DRYING INK ON CONTAINERS

[75] Inventor: Thomas R. Martin, Milwaukee, Wis.

[73] Assignee: Condes Corporation, Milwaukee, Wis.

[21] Appl. No.: 744,812

[22] Filed: Nov. 24, 1976

Related U.S. Application Data

[63] Continuation-in-part of Ser. No. 640,012, Dec. 12, 1975, abandoned.

[51] Int. Cl.[2] ..... B41F 17/00

[52] U.S. Cl. ..... 101/44; 101/32; 34/4; 219/405

[58] Field of Search ..... 101/40, 32, 38 R, 4, 101/38 A, 46, 41, 39, 426; 250/503, 504, 454, 455; 34/4, 1; 432/230; 219/388 C, 405, 411, 343, 354, 347, 348, 349; 350/288, 310

[56] References Cited

U.S. PATENT DOCUMENTS

| | | | |
|---|---|---|---|
| 1,947,171 | 2/1934 | Prussing | 101/38 A X |
| 2,529,704 | 11/1950 | Olsen | 34/4 |
| 3,733,709 | 5/1973 | Bassemir | 34/4 |
| 3,735,697 | 5/1973 | Provan | 101/37 |
| 3,826,014 | 7/1974 | Helding | 34/4 X |
| 3,829,982 | 8/1974 | Pray et al. | 34/4 |
| 3,849,063 | 11/1974 | Eichenlaub | 34/4 X |
| 3,895,574 | 7/1975 | Nyborg | 101/37 |
| 3,934,500 | 1/1976 | Jackson | 101/38 A |
| 3,935,647 | 2/1976 | Aschberger | 34/1 X |

*Primary Examiner*—Edward M. Coven
*Attorney, Agent, or Firm*—James E. Nilles

[57] ABSTRACT

Apparatus is disclosed for applying ultraviolet light reactive ink to several surfaces of egg cartons, and for rapidly drying the ink thereon by ultraviolet light so that the cartons can be immediately stacked and without subjecting the articles to heat damage during drying. A conveyor moves the unfolded egg cartons along a predetermined path at a selected predetermined rate of speed. Printing means apply ink to the cartons. Heat-emitting ultraviolet lamps dry the ink. Fluid motors move the lamps between a position close to the cartons and a position away from the cartons. A control responsive to the rate of speed of carton movement maintains the lamps in the close position to dry the ink when the cartons move at the predetermined rate of speed and move the lamps away from the cartons to continue the ink drying but to prevent heat damage when carton speed decreases. In one embodiment, a single drying unit is located downstream of several printing stations. In another embodiment, an additional drying unit is located between two printing stations. The drying unit includes a tiltable lamp housing having access doors and a safety deflector therewithin for protecting the operator if he reaches through the access doors under the lamps. The control is further responsive to movement of the housing and access doors to move the lamps away from the carton path so as to enable the deflector to be moved to block the radiation.

13 Claims, 12 Drawing Figures

APPARATUS FOR APPLYING AND DRYING INK ON CONTAINERS

REFERENCE TO RELATED CO-PENDING APPLICATION

This application is a continuation-in-part of U.S. patent application Ser. No. 640,012 filed Dec. 12, 1975 by Thomas R. Martin for "Method and Apparatus for Applying Ink to Containers," and now abandoned.

BACKGROUND OF THE INVENTION

Field of Use

The present invention relates to apparatus for applying ultraviolet reactive ink to expanded polystyrene foam articles or containers used, for example, as egg cartons, and for drying or curing the ink by ultraviolet drying means positioned to direct ultraviolet light against the ultraviolet reactive ink to cause rapid drying or curing of that ink without causing heat damage to the articles.

Description of the Prior Art

Containers such as egg cartons and the like have been produced from a variety of materials such as molded pulp, but it has been found to be particularly advantageous in some applications to produce such containers from molded expanded polystyrene foam. However, drawbacks to the use of such material have remained in that the apparatus used for printing and drying the ink on the expanded polystyrene foam articles has consistently failed to provide satisfactory means to dry the ink applied to cartons made of such material. Prior art printing apparatus generally receives a large quantity of cartons disposed in a stacked relation, provides means to separate the cartons and to convey them at high rates of speed to a printing means and then to a restacking station. A drying means is generally disposed between the printing station and the stacked station. Such conveying, printing and restacking means are generally capable of printing 200 to 400 egg cartons per minute. Drying means have not heretofore been provided, however, which are both practical and which completely dry the ink applied to the expanded polystyrene foam cartons before the restacking operation when the cartons are printed at such high rates of speed. The inadequacy of the prior art drying means has resulted in a number of drawbacks. For example, it has not been possible to apply ink to those carton surfaces which are received against the surfaces of adjacent cartons during the restacking process.

SUMMARY OF THE INVENTION

The invention relates generally to apparatus for applying ultraviolet light reactive ink to expanded polystyrene foam articles, such as egg cartons, and for drying the ink thereon immediately after printing by means of ultraviolet light without subjecting the articles to heat damage so that the cartons can be immediately stacked together. The apparatus comprises: conveyor means for moving the articles along a predetermined path at a selected predetermined rate of speed; printing means for applying ultraviolet light reactive ink to the articles moving along the path; drying means including heat-emitting ultraviolet lamps for emitting ultraviolet light against the articles to dry the ink applied thereto; lamp moving means, including fluid motors, for moving the lamps between a first position close to the articles and a position away from the articles; and control means responsive to the rate of speed of movement of the articles along the path to operate the lamp moving means to maintain the lamps in the close position to effect drying of the ink when the articles are moving at the predetermined rate of speed whereby the articles are not damaged by heat from the lamps and to move the lamps to the position away from the articles to continue the ink drying but to prevent damage to the articles when the rate of speed of movement thereof decreases below the predetermined rate.

The drying means includes a tiltable lamp housing having access doors therein and a radiation deflector with the housing for protecting the operator if he reaches through the access doors under the lamps to adjust the flow of articles in case of a jam, which deflector is selectively movable into and out of a position wherein it is disposed between said lamp and the path of movement. The control means is further responsive to movement of the access doors and tilting of the housing to move the lamps away from the carton path so as to enable the deflector to be moved to block the radiation. The control means is also responsive to tilting of the housing to open position to turn off the lamps therein.

In apparatus for handling egg cartons having a bottom portion and a cover portion and wherein the cartons are conveyed in open condition, the printing means comprises a first printing station whereat ink is applied to opposite outer sides of the cover portion of the carton and a second printing station whereat ink is applied to the top surface and inner surfaces of the cover of the carton. In one embodiment, the drying means comprises a single drying unit located downstream of both printing stations. In another embodiment, the drying means comprises an additional drying unit located between the two printing stations.

The conveying means provide a means for feeding the articles or containers in such a manner that they are held in an unfolded, open, face down position and received by the printing means or printing assembly which includes means for applying ultraviolet reactive ink to the top surface, side surfaces and the bottom (inner) surface of the cover of the articles or any combination of these surfaces. The drying means or drying apparatus of the invention is comprised of a plurality of ultraviolet lamps supported both above and below the conveyor such that the articles passing out of the printing assembly and moving toward the restacking assembly are subjected to ultraviolet light as they pass through the drying apparatus. The intensity of ultraviolet light emitted by the lamps is sufficient to immediately cure the ink as the articles pass through the drying apparatus. Each of the lamps of the ultraviolet drying apparatus are supported by a vertically movable support structure means which facilitates movement of the lamps away from or toward the article conveyor. The support means are in turn operably connected to fluid motors to provide such vertical movement and the fluid motors are controlled such that in the event that the conveyor is caused to slow down or to stop, the lamps will be moved vertically away from the conveyor to prevent the articles disposed thereon from being burned. Each of the lamps is disposed within a lamp supporting housing connected by a flexible conduit to a source of vacuum such that air flow is maintained through the housing and around the lamps to cool the ends of the lamps and to cool the housings. A protective housing is also provided over the lamp assemblies to prevent undesirable emission of ultraviolet light.

The present invention thus provides an improved means for applying a printed image to expanded polystyrene foam containers which facilitates high speed printing and stacking of the containers and which provides means for completely curing the ink prior to the restacking operation. By providing means for completely curing the ink before the restacking operation, it is now feasible to print on the side surfaces of the container covers without smearing of the ink when they are stacked and also to print upon the inside surfaces of the container. The apparatus comprising the drying means is also constructed to be relatively uncomplicated and therefore inexpensive to produce. Furthermore, control means are provided to regulate the relative position of the ultraviolet lamps such that the lamps can be moved away from the articles in the event that the conveying means is either halted or slowed thereby protecting the articles from damage due to the heat emitted by the lamps. Finally, the drying assembly can be provided with a plurality of ultraviolet lamps disposed both above and below the articles such that a variety of surfaces of the articles can be printed.

A description of preferred embodiments of the apparatus of the invention are set forth below. It should be noted, however, that the following description is merely an example of embodiments of the invention and does not define the limits of the invention.

DESCRIPTION OF PREFERRED EMBODIMENTS

Figure 2:
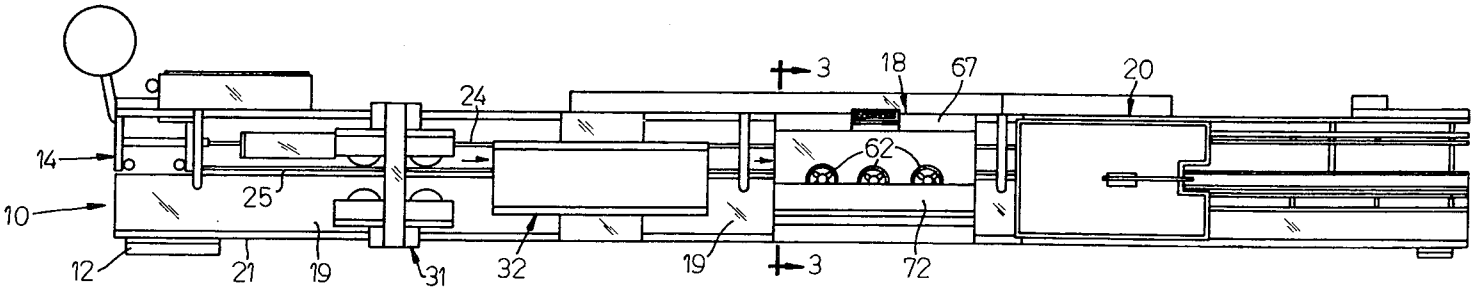
FIG. 2 is a top view of the apparatus shown in FIG. 1.
Figure 1:
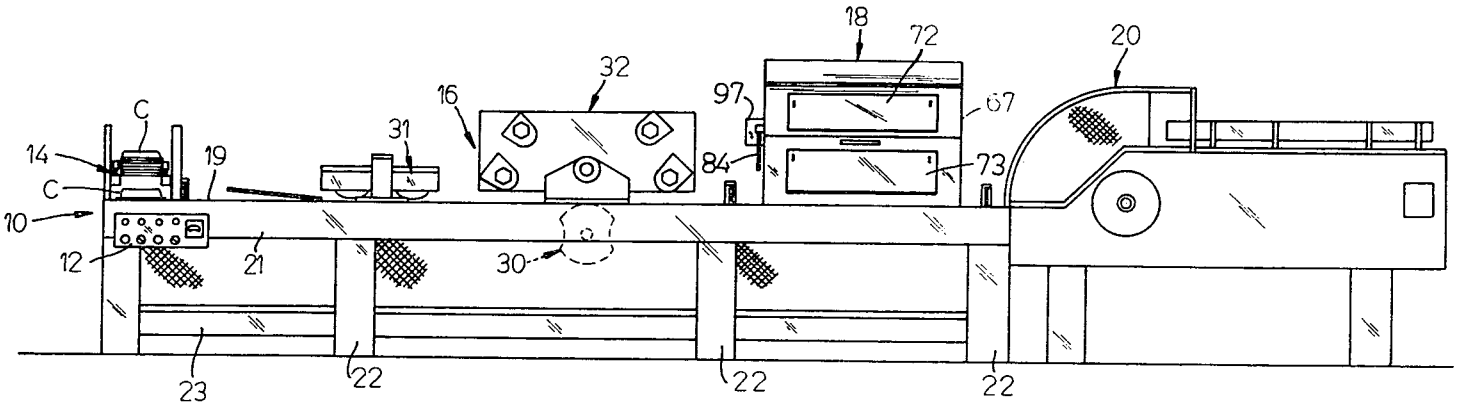
FIG. 1 is a schematic side view of the container printing and drying apparatus of the invention.

FIGS. 1 and 2 illustrate generally a container printing and drying apparatus in accordance with a first embodiment of the invention which is comprised of a plurality of container handling stations spaced along a generally horizontally extending conveyor assembly 10. The conveyor assembly 10 includes means for propelling containers in a left to right direction as viewed in FIGS. 1 and 2, and past each of the various container handling stations spaced along the conveyor assembly 10. The conveyor assembly 10 supports a denester assembly 14, a printing means or assembly 16, a drying means 18 and finally a restacking assembly 20. In operation, the denester assembly 14 is designed to support a plurality of vertically stacked containers C, for example, egg cartons formed from expanded polystyrene foam. The denester assembly 14 separates the containers C and feeds them to the conveyor assembly 10 such that they can be conveyed in a downwardly open and unfolded position to the printing means 16. The printing means 16 includes means for applying ultraviolet light reactive ink to the containers C and they are then conducted to the drying means 18 wherein the ultraviolet ink is immediately dried or cured. The conveyor 10 then moves the containers C to the restacking assembly 20 where they can be restacked and removed for further use.

The conveyor assembly 10 is comprised of a generally horizontally extending frame 21 supported by a plurality of vertical legs 22 and braces 23. The frame 21 supports three parallel horizontal guide rods 24, 25, and 26 as well as a plurality of carrier plates 19 which is combination function to support the containers C. The conveyor assembly 10 also includes a continuous conveying chain 28 positioned slightly below and parallel to guide rod 25 and supporting a plurality of container drive brackets 29, as shown in FIGS. 3–6. As also shown in FIGS. 3–6, the guide rods 24–25 extend along almost the complete length of the conveyor assembly and in combination with carrier plates 19, support the containers in a generally opened and downwardly exposed position as they are moved from the denestor assembly 14 to the restacking assembly 20. The carrier plates 19 generally support the container C cover portion as the container moves along the length of the conveyor assembly 10 and the other half of the container is supported by the guide rod 24. When the containers pass through the drying means 18, however, the cover portion of each of the containers is supported by the guide rod 26. In the drying means, two of the guide rods 24 and 26 are shown positioned below the opposite sides of the container and the third guide rod 25 is shown positioned above the hinged center section of the container. The container drive brackets 29 are spaced along the length of the continuous conveying chain 28 and are designed to be received in abutting relationship against one side of the containers C for forcing them along the conveyor assembly 10. The conveyor chain 28, driven by an electric motor **28*a*, feeds the containers C to the various stations at speeds on the order of 200–400 per minute. The speed of the motor 28*a* and conveying chain 28 can be regulated, however, by a motor control means hereinafter described in order to permit the machine operator to vary the speed with which the containers are fed through the printing assembly 16 and through the drying means 18**.

Figure 3:
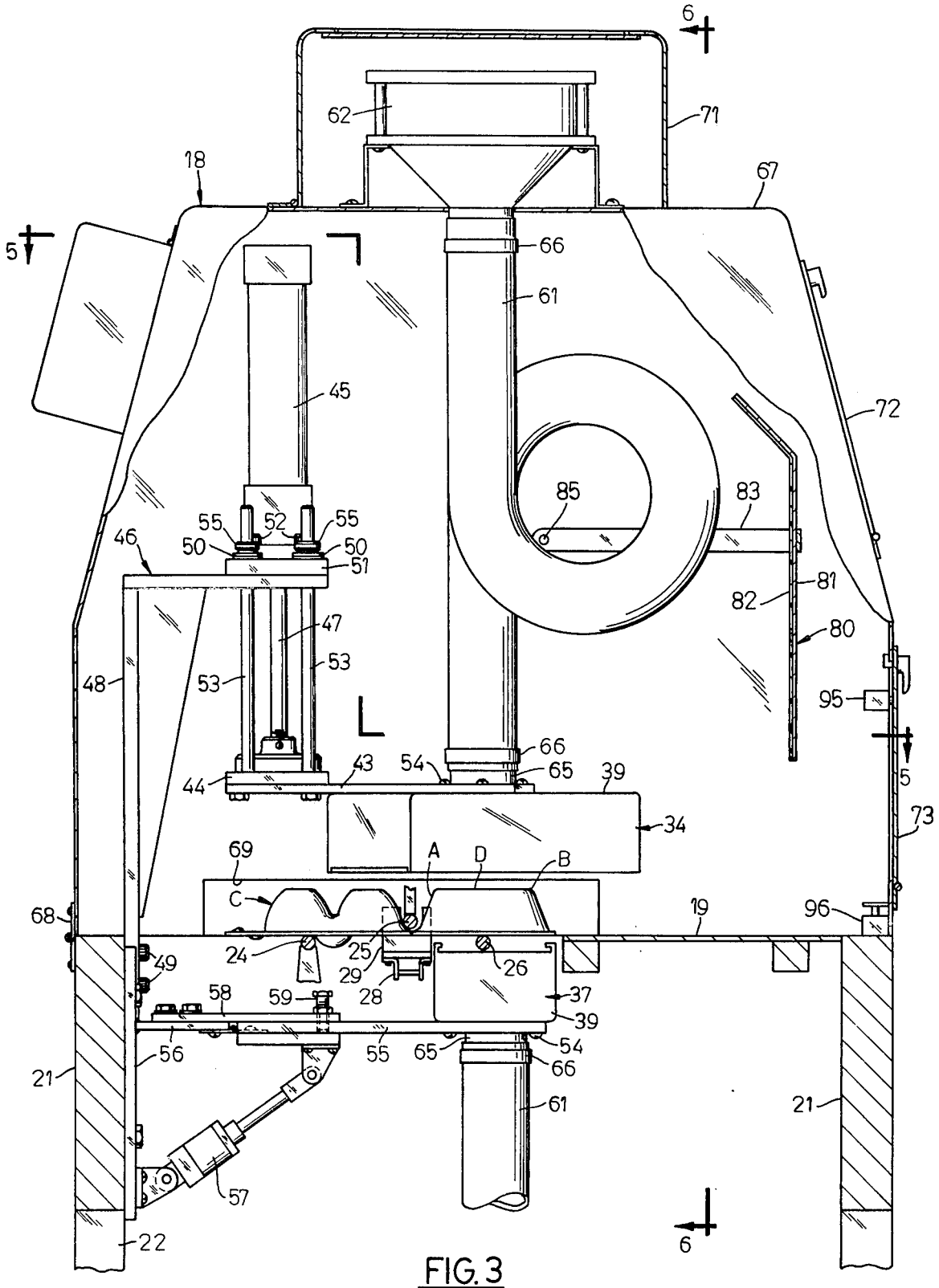
FIG. 3 is an enlarged cross-sectional view taken generally along the line 3—3 in FIG. 2 and showing the ultraviolet drying apparatus.

The printing assembly 16 which is shown in FIGS. 1 and 2, includes a first side printing assembly 31 which functions to apply ultraviolet reactive ink to the opposite side surfaces A and B of the top portion of an egg carton as shown in FIG. 3. The printing assembly 16 also includes an adjacent printing assembly 32 for applying the ultraviolet reactive ink to the top surface D of the carton cover, and a lower printing assembly 30 for printing upon the interior surface of the carton cover opposite the top surface D.

After the container C is moved through the printing assembly 16 and receives ultraviolet ink applied to its various surfaces as described, the container is then conveyed through the ultraviolet drying assembly 18 and then to the restacking station 20 where each of the containers are received individually and restacked such that they can be removed for subsequent use. In order to ensure that the ink applied to the containers is not smeared or in some other way damaged by the restacking process, wherein it is necessary that various surfaces of the containers will rub against surfaces of adjacent containers, it is necessary that the drying assembly 18 provide means to completely dry the ink before the cartons reach the restacking station.

Figure 4:
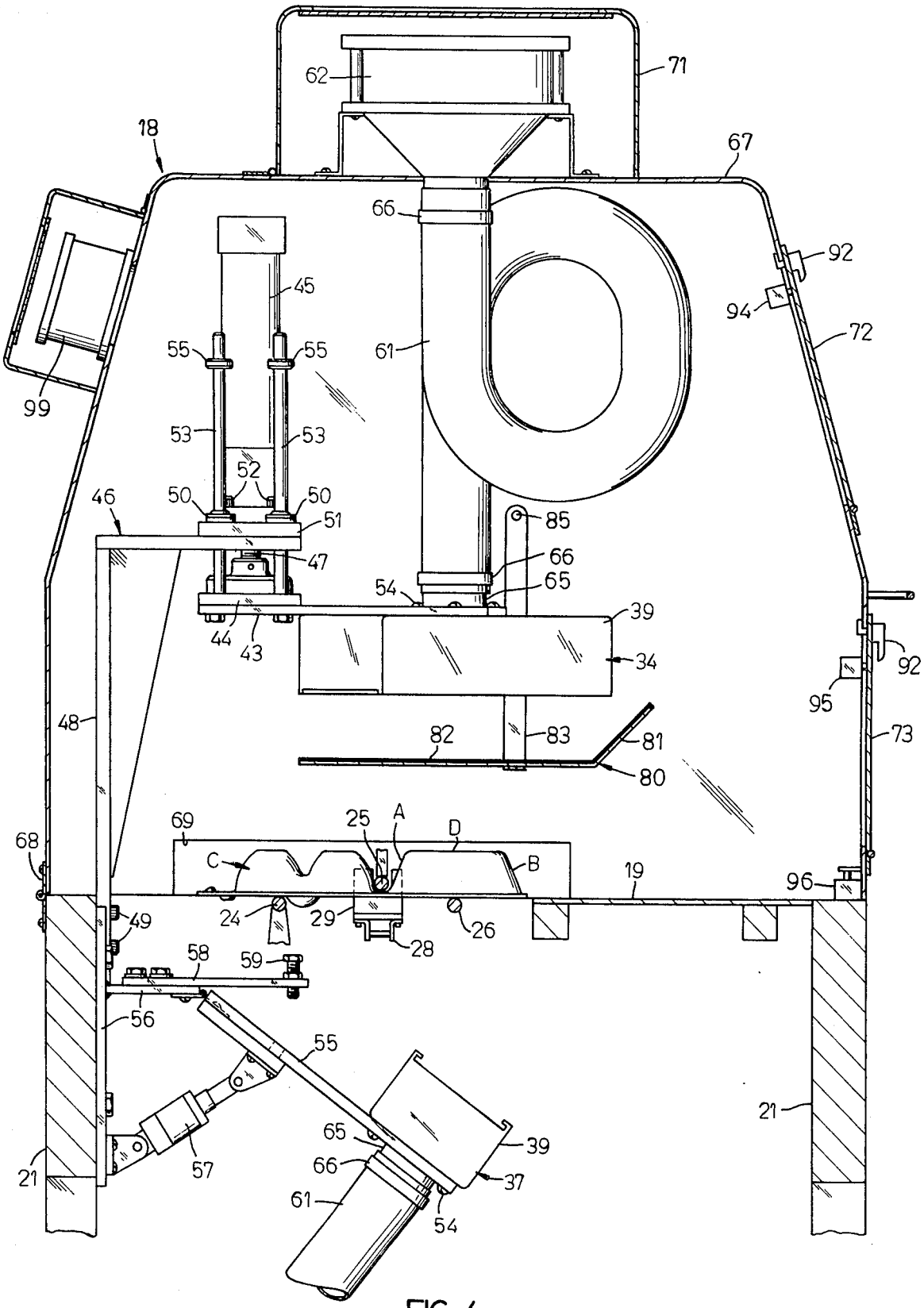
FIG. 4 is a view similar to FIG. 3 but showing the ultraviolet lamps of the drying apparatus positioned away from the containers being dried.
Figure 5:
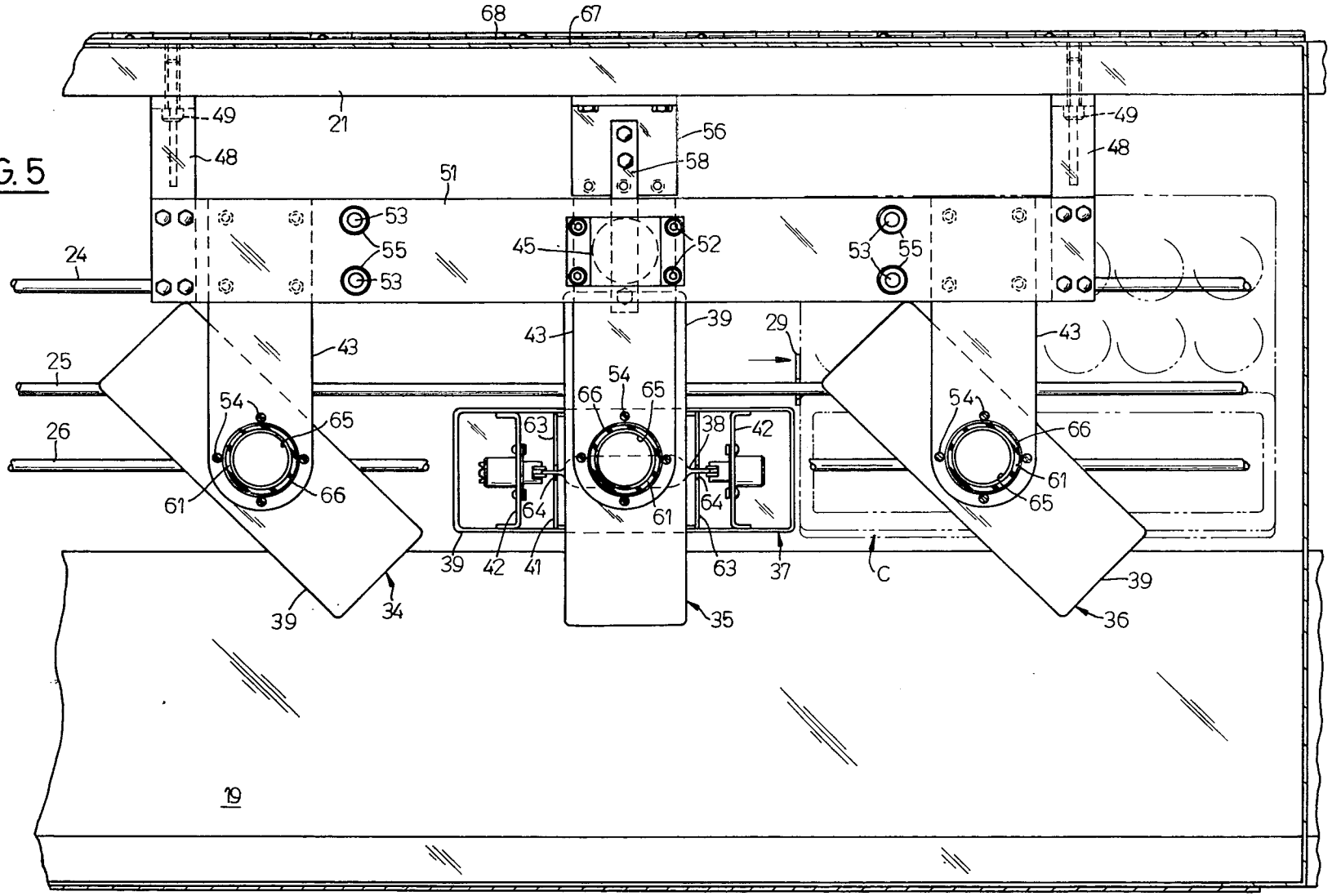
FIG. 5 is a partial cross-sectional plan view of the ultraviolet drying apparatus taken generally along the line 5—5 in FIG. 3.
Figure 6:
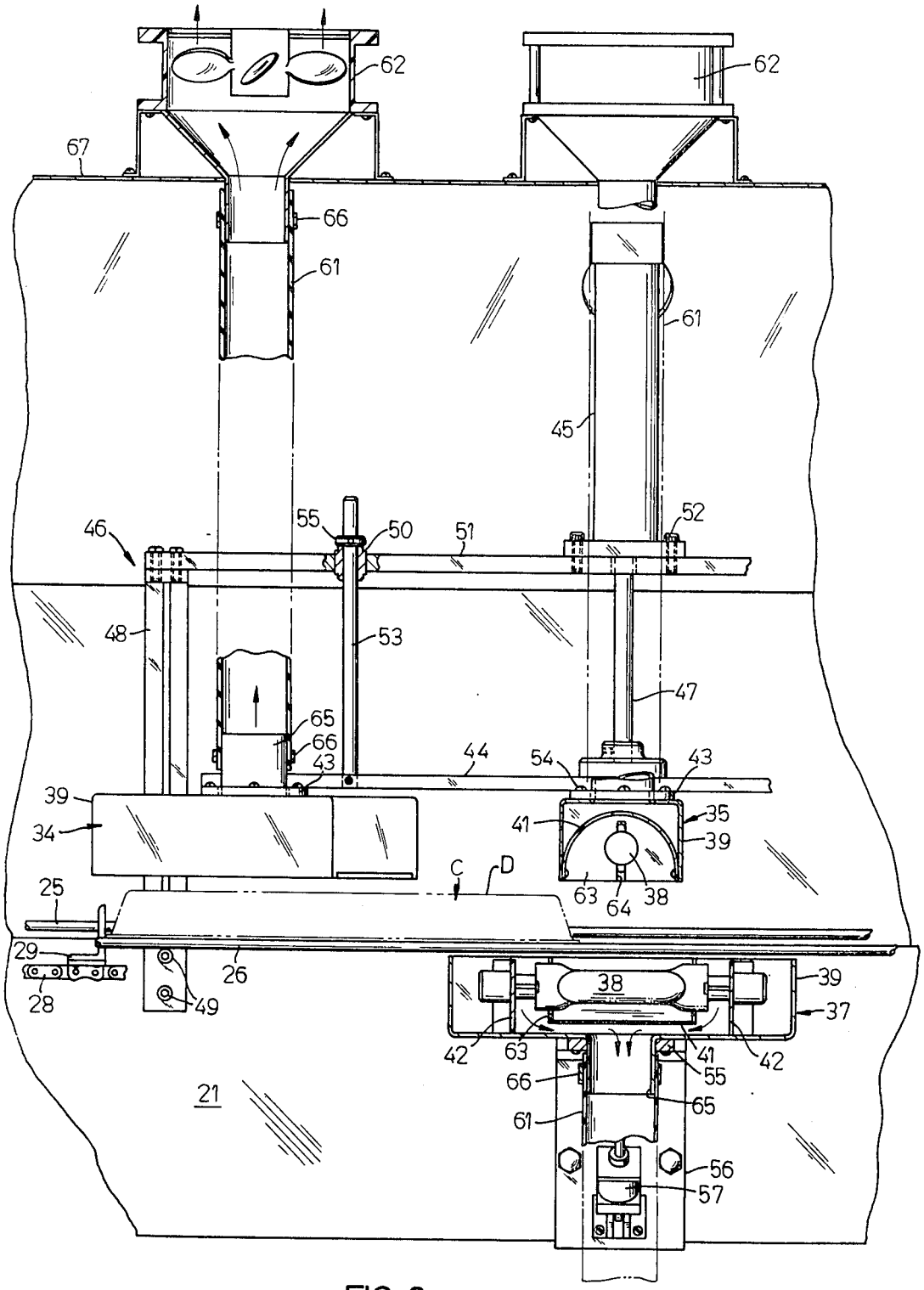
FIG. 6 is a cross-sectional side view of the ultraviolet drying apparatus taken generally along the line 6—6 in FIG. 3 and showing certain parts cut away in the interest of clarity.

The ultraviolet drying assembly 18 is more specifically shown in FIGS. 3–6. Generally, the drying assembly 18 includes a plurality of ultraviolet lamp assemblies 34, 35, and 36 which are positioned above the conveyor assembly 10 and the container C for directing ultraviolet light downwardly onto the surfaces A, B, and D of the containers. An additional ultraviolet lamp assembly 37 is positioned below the containers and is functional to direct ultraviolet light upwardly against the inside printed surface of the container. As best shown in FIG. 6, each of the lamp assemblies 34–37 is comprised of an ultraviolet lamp 38 disposed in a generally horizontal position in a lamp housing 39 which includes a generally semicylindrical reflector 41 mounted adjacent and parallel to the lamp 38 and designed to direct light emitted by the lamp toward the respective container surfaces. The lamp assemblies 34 and 36 are positioned in angular relationship with respect to the direction of movement of the containers C, as shown in FIG. 5, such that the lamps 38 therein radiate light against the surfaces D. The lamp assembly 35, on the other hand, extends perpendicular to the containers C such that the light radiating from the lamp therein also strikes the side surfaces A and B.

The lamp assemblies 34–36 which are mounted above the container C are each supported in cantilevered relationship from the ends of brackets 43. The brackets 43 are each bolted at one end to an elongated bar 44 connected to the lower end of a piston rod 47 of a fluid cylinder 45. The fluid cylinder 45 is supported by a support bracket assembly 46 such that the piston rod 47 supporting the elongated bar 44 and lamp assemblies 34–36 extend vertically downwardly. The support bracket assembly 46 comprises a pair of vertically extending angles 48 which are bolted to the frame 21 by bolts 49. The angles 48 in turn support a horizontal beam 51 which extends therebetween and which is parallel to the elongated bar 44. The fluid cylinder 45 is rigidly secured to the beam 51 in a vertically oriented position by a plurality of bolts 52, and the bar 44 and the beam 51 are maintained in parallel alignment by four guide rods 53 which are secured to the bar 44 and which are vertically slideable in bearings 50 secured within bores in the beam 51. The fluid cylinder 45 is operably connected to the control panel 12 such that the fluid cylinder can be actuated to cause vertical reciprocating movement of the lamp assemblies 34–36. The guide rods 44, however, include collars 55 secured thereto and receivable against the upper surface of the bearings 50 to provide a stop limiting the possible downward movement of the lamp assemblies 34–36.

As is well known in the art, ultraviolet lamps generally require a substantial period of time after they are turned on in order to reach their maximum efficiency, and therefore it is desirable that the lamps should not be turned off. However, if the lamp assemblies are positioned close to the containers and the speed of the conveyor decreases such that the containers are subjected to radiation from the lamps for extended periods of time, the containers will be scorched. In order to protect the containers from damage in the event that the conveyor assembly 10 slows down or stops, the control panel 12 includes means operable to automatically actuate the fluid cylinder 45 in order to move the lamp assemblies 34–36 upwardly away from the containers C and thereby prevent damage to the containers even though the conveyor slows down substantially.

The lower lamp assembly 37 is also supported for vertical movement with respect to the containers C. As shown in FIGS. 3 and 4, the lower lamp assembly 37 is secured by screws 54 to a pivotable support arm 55 which is operably connected for vertical swinging movement to a second fluid cylinder 57. The pivotable support arm is hingedly attached to a rigid bracket 56 which is secured to the frame 21. The fluid cylinder 57 is actuatable to cause a swinging movement of the lamp assembly from the position shown in FIG. 3 to the position shown in FIG. 4 and vice-versa. The lower lamp assembly 37 also includes a horizontally extending stop arm 58 which is rigidly secured at one end to the bracket 56 and functions to prevent swinging movement of the support arm upwardly beyond a horizontal position. The stop arm 58 also includes an adjustable stop member 59 to facilitate accurate positioning of the upper limits of movement of the lamp assembly 37. Like the fluid cylinder 45, the fluid cylinder 57 is operably connected to the control panel 12 such that both fluid cylinders can be actuated simultaneously.

Figure 7:
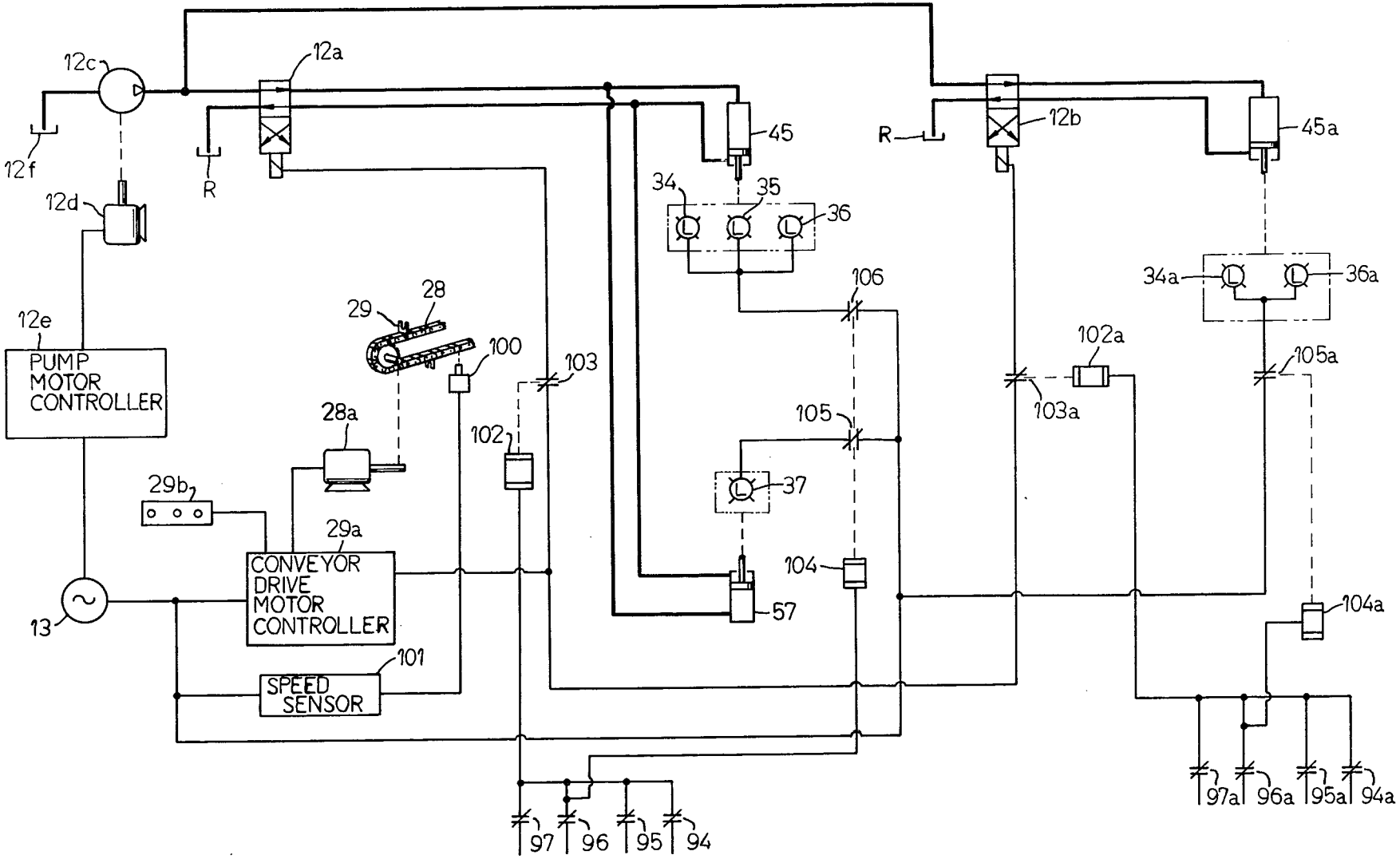
FIG. 7 is a schematic view of the control circuit for operating the fluid motors used in the drying apparatus.

FIG. 7 illustrates a control circuit, hereinafter described in detail, which can be used to effect operation of the fluid motors 45 and 57 in the event that the speed of the conveyor increases to a predetermined value. The control includes a conventional speed sensing means which senses the speed at which conveyor chain 28 (or other driven conveyor component) moves and provides an electrical impulse when the speed of the conveyor raises below a set speed. The electrical impulse in turn actuates a solenoid operated four-way valve **12*a* which then permits pressure flow from a pump 12*c* to communicate with the fluid motors 45 and 57, so as to cause retraction of the fluid motors, whereby the lamp assemblies are moved away from the containers. During normal operation, the solenoid operated valve 12*a* functions to connect the pump 12*c* to the fluid motors 45 and 57** so that the fluid motors are extended and the lamp assemblies are positioned in close relationship to the container.

As is well known in the art, ultraviolet lamps disposed within the ultraviolet assemblies 34–37 emit substantial quantities of heat. In order to dissipate this heat to prevent both damage to the lamps 38 as well as to prevent damage to the containers received in the drying assembly 18, each of the lamp assemblies 34–37 is connected to a flexible hose or conduit 61. The conduits 61 connected to the lamp assemblies 34–36 have a generally looped configuration so as to compensate for vertical movement of the assemblies and are each connected at their upper ends to a fan 62. The hose 61 extending from the lamp assembly 37 is similarly flexible and is also connected to a fan assembly (not shown).

The particular structure of each of the ultraviolet lamp assemblies 34–37 is best shown in FIGS. 5 and 6. The lamp housings 39 of the lamp assemblies are shown as being comprised of generally rectangular box-like members open along one side to permit the emission of ultraviolet light. A pair of partitions 42 are located within the box-like configuration and are spaced from but adjacent to its ends and provide means for supporting the ends of the ultraviolet lamps 38. The lamps 38 are surrounded by a reflector 41 which has a generally semi-cylindrical configuration but which includes slots 64 in its ends 63 to receive the ends of the lamp 38. The surface of the generally cylindrical reflector 41 should be comprised of materials having high reflective properties in order that the greatest possible amount of ultraviolet light can be reflected against the various printed surfaces of the containers. As previously stated, each of the lamp assemblies 34–37 is connected to a flexible hose 61. The hose 61 is received over a sleeve 65 extending from the back of lamp housing 39 and clamped onto the sleeve by a clamping ring 66. The air flow through the lamp assemblies caused by the fan 62 is shown in FIG. 6. It will be noted that the air flow is generally around the ends of the lamp 38 and across the back of the reflector 63 in order to prevent the heat emitted by the lamp from causing damage to the ends or sockets of the lamp 38 and also prevents damage to the reflector.

Since ultraviolet light emitted by the ultraviolet lamp assemblies can be harmful to the machine operator or others, a protective hood assembly 67 covers each of the elements of the drying means 18 to prevent emission of ultraviolet light. As shown in FIG. 3, the hood assembly 67 is attached by means of a hinge 68 to the frame 21 and can be lifted to facilitate maintenance, etc. When the hood is closed, the only substantial openings in the hood assembly 67 are formed by the container receiving openings 69. However, since the containers C are positioned in side-by-side relationship on the conveyor as they pass through the drying assembly 18, very little ultraviolet light is permitted to escape through the container receiving openings 69. As shown in FIGS. 3 and 4, the hood assembly 67 also provides support for the fans 62 as well for a fan hood deflector 71. Hood assembly 67 is provided with upper and lower operator access doors 72 and 73, respectively, which enable the operator to reach therein to make adjustments and facilitate carton flow in the event of a carton jam. Hood assembly 67 is also provided with a pivotable safety deflector assembly 80 to protect the operator, which deflector assembly is hereinafter described in detail as to construction and mode of operation. In the embodiment shown in FIGS. 1–6, the upper lamp assemblies and related components are shown mounted on and supported by the conveyor 10. However, as hereinafter appears in connection with the embodiment shown in FIGS. 9–12, the lamp assembly is mounted on, supported by, and movable with the hood assembly **67*a*** hereinafter described.

FIGS. 8–12 illustrate additional apparatus over that shown in FIGS. 1–6, but similar parts have been similarly numbered together with a suffix *a*.

Figure 8:
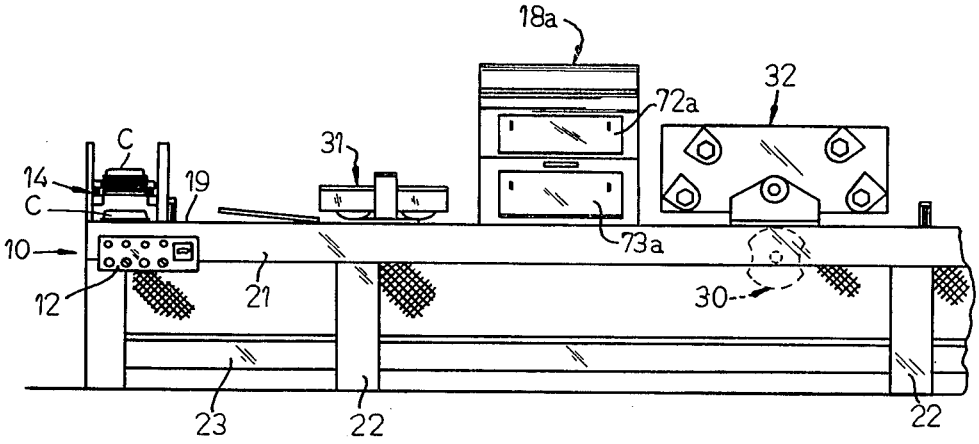
FIG. 8 is a partial, elevational view of a second embodiment of the invention wherein a second drying apparatus is disposed between a printing means for applying ultraviolet ink to the side surfaces of the covers of the cartons and a printing means for applying ultraviolet ink to the top and bottom surfaces of the covers of the cartons.

FIG. 8 illustrates a second embodiment of the invention wherein a second drying apparatus **18*a* is disposed between the first printing assembly 31 and the printing assembly 32. The printing assembly 31, as stated previously, is intended to apply ultraviolet ink to the side surfaces of the cover of a foam container and the drying assembly 18*a* is intended to direct ultraviolet light against the side surfaces to dry or cure the ultraviolet reactive ink on those surfaces. The foam containers are then conveyed through the printing assembly 32 wherein ultraviolet reactive ink can be applied to the top surface of the cover and through printing assembly 30 wherein such ink can be applied to the inside surface of the cover as stated previously. After the ink is applied by the printing assemblies 30 and 32, the containers are then conveyed to a second ultraviolet drying apparatus 18** of the type previously defined.

The ultraviolet drying apparatus **18*a* is shown more clearly in FIGS. 9–12 and differs from the curing apparatus 18 in that it is provided with a pair of lamp assemblies 34*a* and 36*a*. These lamp assemblies 34*a* and 36*a* are similar to the lamp assemblies 34 and 36 except that they are supported in such a manner that they direct radiation generally towards each other, i.e., downwardly and inwardly toward the sloped side surfaces of the cover of the foam container. The lamp assemblies 34*a* and 36*a* are supported in a manner and by means similar to the support structures described hereinbefore which support the lamps 34, 35, and 36, except that an angular bracket 43*a* is provided to support each of the lamp assemblies 34*a* and 36*a*. A hood ventilation fan 99*a* is provided on housing 67*a***.

The ultraviolet lamp assemblies **34*a* and 36*a* are positioned above the conveyor assembly 10 and the container C for directing ultraviolet light angularly onto the side surfaces A and B of the containers. Each of the lamp assemblies 34*a*–36*a* is comprised of an ultraviolet lamp 38*a* disposed in a lamp housing 39*a* which includes a generally semi-cylindrical reflector 41*a* mounted adjacent and parallel to the lamp 38*a* and designed to direct light emitted by the lamp toward the respective container surfaces. The lamp assemblies 34*a* and 36*a* are positioned in angular relationship with respect to the direction of movement of the containers C, as shown in FIG. 10, such that the lamps 38*a*** therein radiate light against the side surfaces A and B.

The lamp assemblies **34*a* and 36*a* which are mounted above the container C are each supported in cantilevered angular relationship from the ends of bracket 43*a* which has downwardly bent ends. The bracket 43*a* is bolted intermediately of its ends to an elongated bar 44*a* connected to the lower end of a piston rod 47*a* of a fluid cylinder 45*a*. The fluid cylinder 45*a* is supported by a support bracket assembly 46*a* such that the piston rod 47*a* supporting the elongated bar 44*a* and lamp assemblies 34*a* and 36*a* extends vertically downwardly. The support bracket assembly 46*a* comprises a pair of vertically extending angles 48*a* which are bolted to the frame 21 by bolts 49*a*. The angles 48*a* in turn support a horizontal beam 51*a* which extends therebetween and which is parallel to the elongated bar 44*a*. The fluid cylinder 45*a* is rigidly secured to the beam 51*a* in a vertically oriented position by a plurality of bolts 52*a*, and the bar 44***a* and the beam 51*a* are maintained in parallel alignment by guide rods 53*a* which are secured to the bar 44*a* and which are vertically slideable in bearings 50*a* secured within bores in the beam 51*a*. The fluid cylinder 45*a* is operably connected to the control panel 12 such that the fluid cylinder can be actuated to cause vertical reciprocating movement of the lamp assemblies 34*a* and 36*a*. The guide rods 44*a*, however, include collars 55*a* secured thereto and receivable against the upper surface of the bearings 50*a* to provide a stop limiting the possible downward movement of the lamp assemblies 34*a* and 36*a*.

In order to protect the containers from damage in the event that the conveyor assembly 10 slows down or stops, the control panel 12 includes means operable to automatically actuate the fluid cylinder 45*a* in order to move the lamp assemblies 34*a* and 36*a* upwardly away from the containers C and thereby prevent damage to the containers even though the conveyor slows down substantially.

Figure 11:
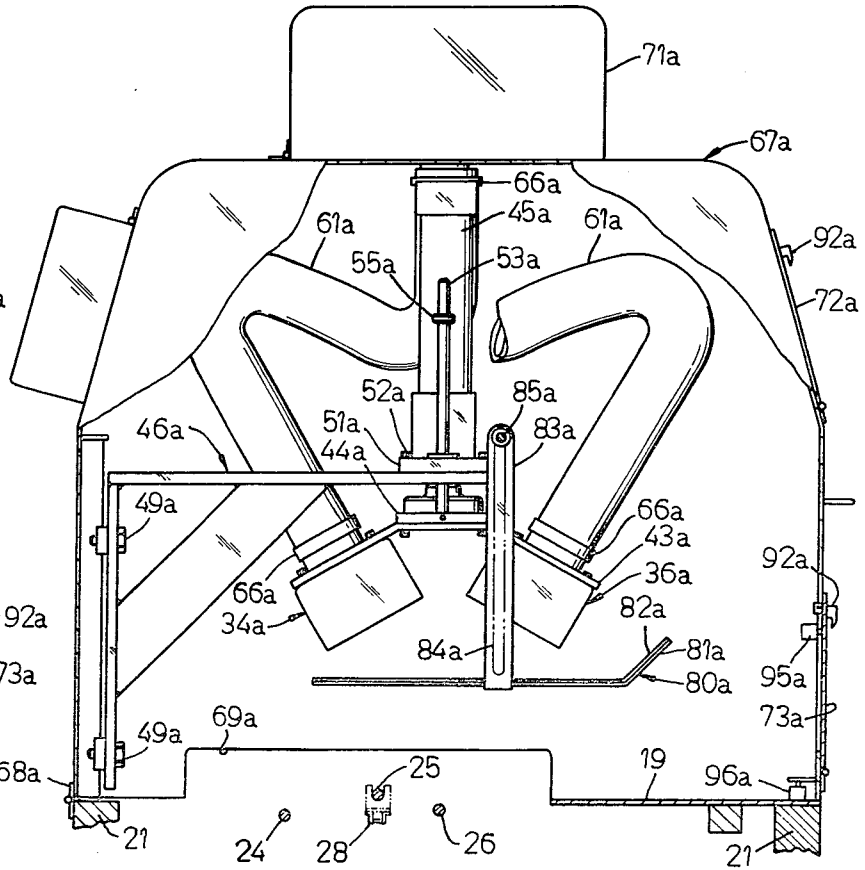
FIG. 11 is a view similar to FIG. 10 but showing the ultraviolet lamps in a raised position and a deflector assembly in a position wherein it prevents ultraviolet radiation from striking the hand of a press operator.
Figure 10:
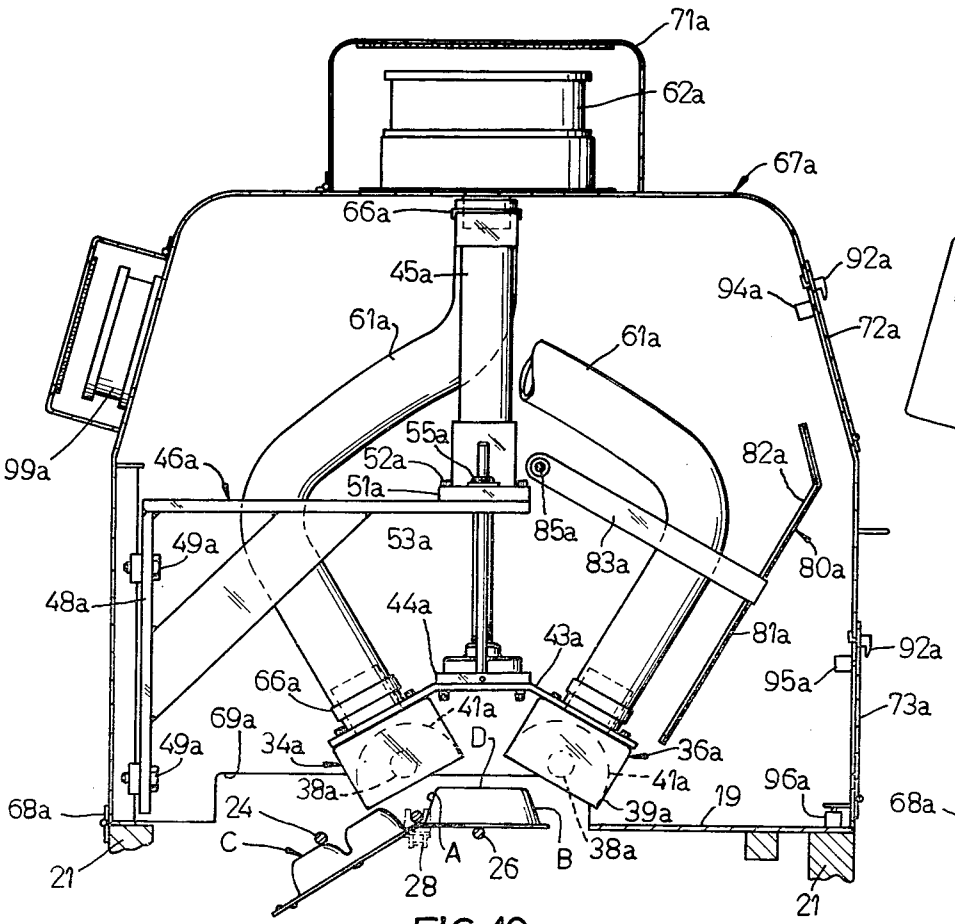
FIG. 10 is a cross-sectional, elevational view of the drying apparatus shown in FIG. 9, but on an enlarged scale.
Figure 12:
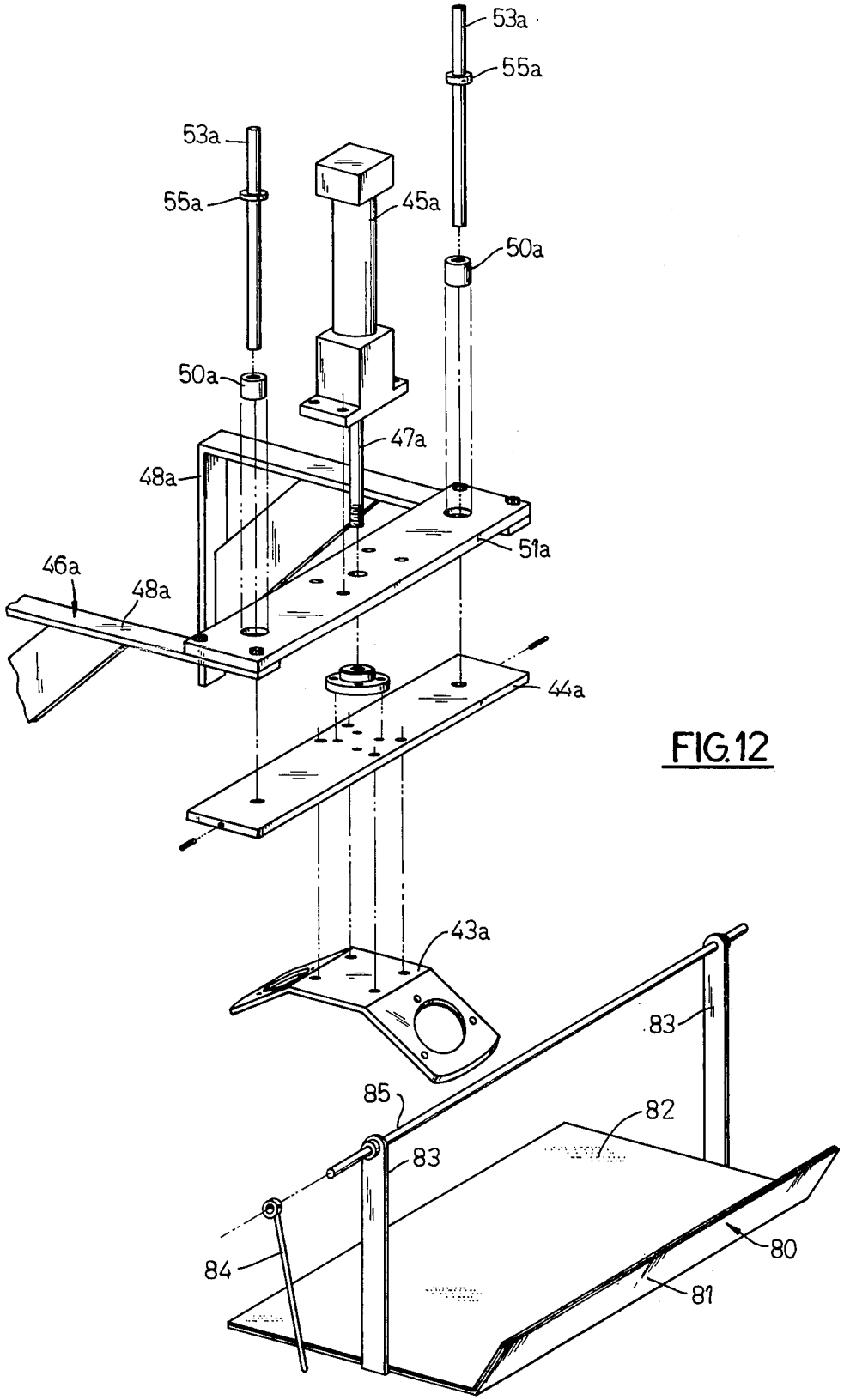
FIG. 12 is an exploded view of a structure for supporting the ultraviolet lamps of the drying apparatus shown in FIGS. 8 through 11 and also the deflector assembly of FIGS. 11 and 12.

The drying apparatus 18*a*, like the drying apparatus 18, is also provided with a pivotable safety deflector assembly 80*a* (FIGS. 10 through 12). Since deflector assembly 80 and 80*a* are similar in construction, mode of operation and purpose, only deflector assembly 80*a* is hereinafter described in detail. Deflector assembly 80*a* includes a generally flat deflector plate 81*a* having an asbestos coating 82*a* and supported for pivotable movement from the position shown in FIG. 10 to a position (FIG. 11) where it is positioned in a generally horizontal relationship between the foam containers and the ultraviolet radiation emitting lamps 34*a* and 36*a* and blocks the latter from the foam containers. The deflector plate 81*a* is supported by a pair of pivotable arms 83*a* having their upper end supported by a longitudinally extending rod 85*a* which is supported on the sides of the hood assembly 67*a*. The purpose of the deflector plates 81 and 81*a* is to permit the operator to reach into the drying apparatus, in the event that one of the foam cartons becomes jammed in the drying apparatus, to correct the situation without having ultraviolet radiation contact his skin.

In order to facilitate access to the interior of the drying apparatus 18*a*, the pivotable cover or housing or tunnel 67*a* of the drying apparatus 18*a* is similar to housing 67 and is provided with a pair of elongated longitudinally extending doors 72*a* and 73*a*, each pivotably attached to the cover 67*a* and securable in place by a pair of latches 92*a*.

Figure 9:
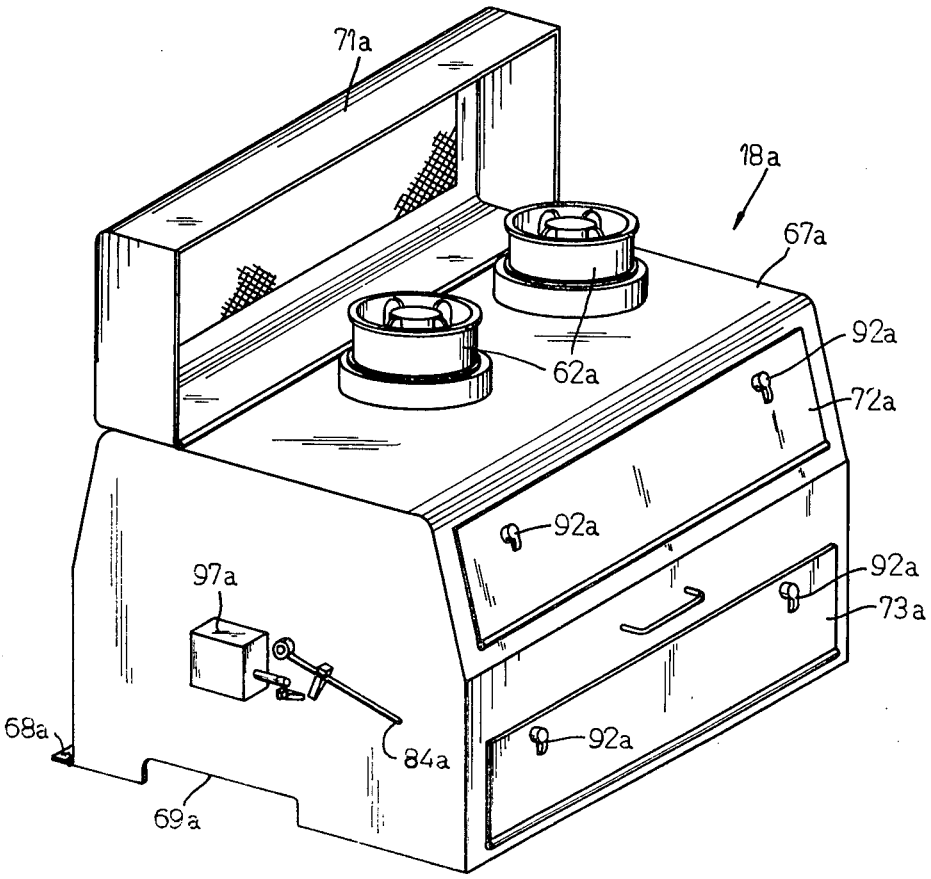
FIG. 9 is an enlarged, perspective view of part of the drying apparatus shown in FIG. 8 but showing the fan cover thereof in a raised position.

As FIGS. 7 and 9 show, the tunnel doors 72*a* and 73*a*, the tunnel or hood assembly 67*a*, and the deflector assembly 80*a* are each provided with electrical interlocks in the form of switches 94*a*, 95*a*, 96*a*, 97*a*, respectively. If a tunnel door 72*a* or 73*a* is opened, the lamp assemblies 34*a* and 36*a* retract (raise or lift) but the lamps remain "on." Thus, in the event that a foam carton becomes obstructed in the curing apparatus, the operator may then open the doors 72*a* and 73*a* to gain access to the foam carton and effects operation of one of the switches 94*a* or 95*a* connected to the control panel 12 to cause fluid motor 45*a* to raise the lamps 34*a* and 36*a* to a position where they are translationally spaced from the foam cartons. The operator can then pivot a lever 84*a* attached to an exterior end of rod 85*a* from the position shown in FIG. 9 to a position wherein the deflector assembly 80*a* is interposed between the lamp assemblies 34*a* and 36*a* and the carton path, as shown in FIG. 11. If the housing 67*a* is raised (i.e., tilted to open position affording access to equipment therebeneath), the lamp assemblies 34*a* and 36*a* retract and both turn "off." The deflector assembly 80*a* is interlocked by means of switch 97*a* to prevent the lamp assemblies 34*a* and 36*a* from colliding with the deflector plate 81*a*. Thus, if the deflector plate 81*a* is lowered, the interlock switch 97*a* causes the lamp assembly to remain upward (i.e., prevents them from being lowered) but the lamps stay "on."

Referring again to FIG. 7, there is shown a control circuit for operating the embodiment of the invention described in connection with FIGS. 8–12 which has two driers. However, portions of the control system are suitable for independent use to control the embodiment shown in FIGS. 1–6 which has only one drier. As FIG. 7 shows, a pump 12*c* is provided to provide fluid from a source 12*f* to the four-way valves 12*a* and 12*b* for controlling movement of the fluid cylinders 45, 37, and 45*a*, respectively. Pump 12*c* is driven by an electric motor 12*d* which is energizable from an electric power source 13 by means of a pump motor controller 12*e*.

Conveyor 28 for moving the carbons C is driven by an electric motor 28*a* which is energizable from electric power source 13 by means of a conveyor drive motor controller 29*a*. Motor controller 29*a* is provided with a control device 29*b* for starting and stopping motor 28*a* and for operating motor 28*a* at whatever speed is desired within its operating range.

Means are provided to sense the rate of speed at which the containers C are being moved by conveyor 28 and such means comprise a photoelectric cell 100 mounted adjacent conveyor chain 28 for providing electric signals indicative of conveyor speed to a conventional speed sensor 101 which in turn provides operating signals to the solenoid operated four-way control valves 12*a* and 12*b*. Speed sensor means 101 are energizable from electric power source 13. In the embodiment shown, the valves 12*a* and 12*b* are two-position valves which effect movement of their respective associated cylinders to up or down positions in response to signals from speed sensor 101. For example, if the apparatus is running over 50 cartons per minute, the lamp assemblies are in down position. When the apparatus is stopped or running under 50 cartons per minute, the lamp assemblies are in the up position.

As FIGS. 3, 4, 7, and 9 show, interlock switches are provided for effecting energization of the lamps and movement of the lamps as hereinafter explained in detail. For example, housing 67 is provided with access doors 72 and 73 to permit the operator to reach therewithin and the housing 67 is also tiltable to a position wherein it can expose the lamp assemblies. Similarly, housing 67 is provided with access doors 72*a* and 73*a* and is also tiltable. As FIG. 7 shows, the doors 72 and 73 are provided with limit switches 94 and 95, respectively, which operate a relay 102 to actuate a switch 103 for valve 12*a* so as to cause the cylinders 45 and 57 to retract the lamps associated therewith when either of the doors 72 or 73 is opened. The housing 67 is also provided with a switch 96 which operates when the hood is raised to cause relay 102 to operate its contacts 103 to raise the lamps. Switch 96 also operates a relay 104 having contacts 105 and 106 which cause the lamps 37 and 34, 35, 36 to turn off when the housing is raised. Housing 67 is also provided with a deflector interlock switch 97 which is actuated by the lever arm or handle 84 of deflector assembly 80 when the latter has been moved to a position between its associated lamps and the path of movement of the cartons C to prevent the lamps from moving from the raised position to the lowered position. Thus, deflector interlock switch 97 prevents the lamps from descending and being damaged by contact with the deflector assembly because the valve 12*a* cannot then be actuated to cause the cylinder 45 to extend its lamps until the deflector assembly 81 is moved out of interferring relationship with the lamps. It is desirable that the lamps be turned off when the housing is raised so that the operator is not directly exposed to ultraviolet radiation. However, because it is difficult to restart the lamps, it is desirable that they remain on if the housing 67 is in closed position and only the access doors 72 or 73 are opened.

Housing 67*a* likewise is provided with access doors 72*a* and 73*a* to permit the operator to reach therewithin and the housing 67*a* is also tiltable to a position wherein it can expose the lamp assemblies which are movable therewithin. As FIG. 7 shows, the doors 72*a* and 73*a* are provided with limit switches 94*a* and 95*a*, respectively, which operate a relay 102*a* to actuate a switch 103*a* for valve 12*b* so as to cause the cylinder 45*a* to retract the lamps associated therewith when either of the doors 72*a* or 73*a* is opened. The housing 67*a* is also provided with a switch 96*a* which operates when the hood is raised to cause relay 102*a* to operate its contacts 103*a* to raise the lamps. Switch 96*a* also operates a relay 104*a* having contacts 105*a* which causes the lamps 34*a* and 36*a* to turn off when the housing is raised. Housing 67*a* is also provided with a deflector interlock switch 97*a* which is actuated by the lever arm or handle 84*a* of deflector assembly 80*a* when the latter has been moved to a position between its associated lamps and the path of movement of the cartons C to prevent the lamps from moving from the raised position to the lowered position. Thus, deflector interlock switch 97*a* prevents the lamps from descending and being damaged by contact with the deflector assembly because the valve 12*b* cannot then be actuated to cause the cylinder 45*a* to extend its lamps until the deflector assembly 81*a* is moved out of interferring relationship with the lamps. It is desirable that the lamps be turned off when the housing is raised so that the operator is not directly exposed to ultraviolet radiation. However, because it is difficult to restart the lamps, it is desirable that they remain on if the housing 67*a* is in closed position and only the access doors 90*a* or 91*a* are opened.

I claim:

1. Apparatus for applying ultraviolet light reactive ink to articles susceptible to damage from excessive heat and for drying the ink thereon comprising:

conveyor means for moving said articles along a path at a predetermined speed;

printing means for applying ultraviolet light reactive ink to said articles moving along said path;

drying means including a heat-emitting ultraviolet lamp for emitting ultraviolet light toward said articles moving along said path to dry said ink thereon, said drying means comprising a housing wherein said lamp is disposed, said housing having an access door thereon and a deflector mounted therein, said deflector being selectively movable between one position wherein it is disposed between said lamp and said path of movement and another position wherein it is removed from between said lamp and said path;

lamp moving means for moving said lamp between a position near said articles and a position farther away from said articles, said lamp remaining illuminated and effecting drying of ink in both positions;

and control means responsive to the speed of said articles past said lamp to operate said lamp moving means to maintain said lamp in said near position to effect drying of said ink without effecting heat damage to said articles when said articles are moving at said predetermined rate of speed and to move said lamp toward said position farther away from said articles to effect drying of said ink without effecting heat damage to said articles when said articles are moving at a speed less than said predetermined speed, said control means comprising a first switch responsive to opening movement of said door to move said lamp from said position near said articles toward said position farther away from said articles as said deflector is moved toward said one position wherein said deflector is disposed between said lamp and said path.

2. Apparatus according to claim 1 wherein said control means further includes a second switch responsive to movement of said deflector to prevent movement of said lamp toward said position near said articles while said deflector is disposed in said one position.

3. Apparatus according to claim 2 wherein said housing is movable between a closed position and an open position and wherein said control means further includes a third switch responsive to movement of said housing to move said lamp from said articles and to turn off said lamp when said housing is moved to open position.

4. Apparatus for applying ultraviolet light reactive ink to articles having upper, lower, and opposite side surfaces susceptible to damage from excessive heat and for drying the ink thereon comprising:

conveyor means for moving said articles along a path at a predetermined speed;

first printing means for applying ultraviolet light reactive ink to said opposite side surfaces of said articles moving along said path;

first drying means including a pair of heat-emitting ultraviolet lamps for emitting ultraviolet light toward said opposite side surfaces of said articles moving along said path to dry said ink thereon;

second printing means for applying ultraviolet light reactive ink to said upper and lower surfaces of said articles moving along said path;

second drying means including at least one upper heat-emitting ultraviolet lamp for emitting ultraviolet light toward said upper surfaces of said articles to dry said ink thereof and including at least one lower heat-emitting ultraviolet lamp for emitting ultraviolet light toward said lower surfaces of said articles to dry said ink thereon, said first and second drying means each comprising a housing wherein a lamp is disposed, said housing having an access door thereon and a deflector mounted therein, said deflector being selectively movable between one position wherein it is disposed between a lamp and said path of movement and another position wherein it is removed from between a lamp and said path;

lamp moving means for moving said lamps between a position near said articles and a position farther away from said articles, said lamps remaining illuminated and effecting drying of ink in both positions;

and control means responsive to the speed of said articles past said lamps to operate said lamp moving means to maintain said lamps in said near position to effect drying of said ink without effecting heat damage to said articles when said articles are moving at said predetermined rate of speed and to move said lamps toward said position farther away from said articles to effect drying of said ink without effecting heat damage to said articles when said articles are moving at a speed less than said predetermined speed, said control means comprising a first switch for each housing responsive to opening movement of said door to move a lamp from said position near said articles toward said position farther away from said articles as said deflector is moved toward said one position wherein said deflector is disposed between a lamp and said path.

5. Apparatus according to claim 4 wherein said control means further includes a second switch for each housing responsive to movement of said deflector to prevent movement of a lamp toward said position near said articles while said deflector is disposed in said one position.

6. Apparatus according to claim 5 wherein each housing is movable between a closed position and an open position and wherein said control means further includes a third switch for each housing responsive to movement of said housing to move a lamp away from said articles and to turn off the lamp when said housing is moved to open position.

7. Apparatus for applying ultraviolet light reactive ink to expanded foam cartons having a bottom portion and a cover portion, said cover portion having upper, lower, and sloped opposite side surfaces, said cartons being susceptible to damage from excessive heat, and for drying the ink thereon comprising:

conveyor means for moving said cartons along a path at a predetermined speed, said cartons being in open condition wherein said upper and lower surfaces face upwardly and downwardly, respectively;

first printing means located above said conveyor for applying ultraviolet light reactive ink to said sloped opposite side surfaces of said cover portions moving along said path;

first drying means including a pair of angularly disposed heat-emitting ultraviolet lamps located above said conveyor for emitting ultraviolet light toward said sloped opposite side surfaces of said cover portions moving along said path to dry said ink thereon;

second printing means including printing units located above and below said conveyor for applying ultraviolet light reactive ink to said upper and lower surfaces, respectively, of said cover portions moving along said path;

second drying means including at least one upper heat-emitting ultraviolet lamp located above said conveyor for emitting ultraviolet light toward said upper surfaces of said cover portions to dry said ink thereon and including at least one lower heat-emitting ultraviolet lamp located below said conveyor for emitting ultraviolet light toward said lower surfaces of said cover portions to dry said ink thereon, said first and second drying means each comprising a housing wherein a lamp is disposed, said housing having an access door thereon and a deflector mounted therein, said deflector being selectively movable between one position wherein it is disposed between a lamp and said path of movement and another position wherein it is removed from between a lamp and said path;

lamp moving means for moving all of said lamps vertically between a position near said cartons and a position farther away from said articles, said lamps remaining illuminated and effecting drying of ink in both positions;

and control means responsive to the speed of said cartons past said lamps to operate said lamp moving means to maintain said lamps in said near position to effect drying of said ink without effecting heat damage to said cartons when said cartons are moving at said predetermined rate of speed and to move said lamps toward said position farther away from said cartons to effect drying of said ink without effecting heat damage to said cartons when said cartons are moving at a speed less than said predetermined speed, said control means comprising a first switch for each housing responsive to opening movement of said door to move a lamp from said position near said cartons toward said position farther away from said cartons as said deflector is moved toward said one position wherein said deflector is disposed between a lamp and said path.

8. Apparatus according to claim 7 wherein said lamp removing means effect translational movement of at least said pair of lamps in said first drying means and said upper lamp in said second drying means.

9. Apparatus according to claim 8 wherein said lamp moving means effects pivotal movement of said lower lamp in said second drying means.

10. Apparatus according to claim 8 wherein said lamp moving means comprises a first fluid motor for moving said pair of lamps in said first drying means, a second fluid motor for moving said upper lamp in said second drying means and a third fluid motor for moving said lower lamp in said second drying means.

11. Apparatus according to claim 7 wherein said control means further includes a second switch for each housing responsive to movement of said deflector to prevent movement of a lamp toward said position near said cartons while said deflector is disposed in said one position.

12. Apparatus according to claim 11 wherein each housing is movable between a closed position and an open position and wherein said control means further includes a third switch for each housing responsive to movement of said housing to move a lamp away from said cartons and to turn off the lamp when said housing is moved to open position.

13. Apparatus according to claim 7 including stacking means for receiving said cartons from said conveyor after said cover portions have been printed and the ink thereon dried and for stacking said cartons one within another with printed surfaces in contiguous relationship.

* * * * *